US009586072B2

(12) United States Patent
Choi

(10) Patent No.: US 9,586,072 B2
(45) Date of Patent: Mar. 7, 2017

(54) SAFE TRAMPOLINE

(71) Applicants: PSKOREA, Daejeon (KR); Pil Sun Choi, Daejeon (KR)

(72) Inventor: Pil Sun Choi, Daejeon (KR)

(73) Assignees: PSKOREA, Daejeon (KR); Pil Sun Choi, Daejeon (KR)

( * ) Notice: Subject to any disclaimer, the term of this patent is extended or adjusted under 35 U.S.C. 154(b) by 0 days.

(21) Appl. No.: 14/787,802

(22) PCT Filed: Aug. 28, 2014

(86) PCT No.: PCT/KR2014/008045
§ 371 (c)(1),
(2) Date: Oct. 29, 2015

(87) PCT Pub. No.: WO2015/030510
PCT Pub. Date: Mar. 5, 2015

(65) Prior Publication Data

US 2016/0166869 A1 Jun. 16, 2016

(30) Foreign Application Priority Data

Aug. 28, 2013 (KR) ..... 10-2013-0102587

(51) Int. Cl.
*A63B 5/11* (2006.01)
*A63B 71/00* (2006.01)

(52) U.S. Cl.
CPC ..... *A63B 5/11* (2013.01); *A63B 71/0054* (2013.01)

(58) Field of Classification Search
CPC ..... A63B 5/11
See application file for complete search history.

(56) References Cited

U.S. PATENT DOCUMENTS 5,385,518 A 1/1995 Turner
2002/0137598 A1* 9/2002 Publicover ..... A63B 5/11 482/27

FOREIGN PATENT DOCUMENTS

JP 02061364 5/1990
KR 2020110006216 6/2011
KR 101285066 7/2013

OTHER PUBLICATIONS

International Search Report—PCT/KR2014/008045 dated Nov. 21, 2014.

* cited by examiner

*Primary Examiner* — Loan H Thanh
*Assistant Examiner* — Jennifer M Deichl
(74) *Attorney, Agent, or Firm* — Cantor Colburn LLP

(57) ABSTRACT

A safe trampoline includes a flat resilient mat, and a support frame including an upper frame formed around the resilient mat and a lower frame for supporting the upper frame. The safe trampoline includes: a plurality of rollers mounted on the upper frame; connection members other than springs, sides of which are indirectly or directly coupled to a periphery of the resilient mat and opposite sides of which are partially wound on the rollers; and resilient bodies, sides of which are coupled to the opposite sides of the connection members and opposite sides of which are fixedly coupled to a specific part of a planar lower location of the resilient mat. The resilient bodies extend or are restored to the original positions according to a load applied to the resilient mat.

7 Claims, 5 Drawing Sheets

SAFE TRAMPOLINE

TECHNICAL FIELD

The present invention relates to a safe trampoline that employs a connection member such as a wire, chemical fibers, or a fabric band and a rotatable member such as a bearing.

BACKGROUND ART

In general, a trampoline is an exercise device in which a net or a resilient mat is connected to a steel frame having a predetermined shape by springs, and refers to an exercise device which the user can scale to jump therefrom. The trampoline is widely known to people as a public exercise device that contributes to treatment as well as exercise through a jumping operation.

However, a trampoline according to the related art may cause a space at a spring part connecting a resilient mat to a frame provided around the resilient mat, frequently causing a safety accident in which a foot drops through the space.

Accordingly, a supplementary measure using a high tension band has been tried, but the resiliency of the band deteriorates and a food of the user still drops down.

In order to solve the safety problem, Korean Utility Model Application Publication No. 20-0006216 (published on Jun. 22, 2011 and entitled "Trampoline Cover") suggests a cover installed at a spring part between a resilient mat and a frame.

However, a problem of dropping a foot of the user may be solved by the cover suggested in the utility model document to a degree, but a space between an edge of the resilient mat covered by the cover and the frame cannot be used. That is, an area for a jumping operation is restricted.

DISCLOSURE

Technical Problem

Therefore, the present invention has been made in an effort to solve the above-mentioned problems, and provides a trampoline that can prevent a safety accident such as drop-down of a foot of the user into a space between a resilient mat and a frame and show an excellent spatial utility by which a space for a jumping operation is not limited.

Technical Solution

In accordance with an aspect of the present invention, there is provided a safe trampoline including a flat resilient mat, and a support frame including an upper frame formed around the resilient mat and a lower frame for supporting the upper frame, the trampoline including: a plurality of rollers mounted on the upper frame; connection members other than springs, sides of which are indirectly or directly coupled to a periphery of the resilient mat and opposite sides of which are partially wound on the rollers; and resilient bodies, sides of which are coupled to the opposite sides of the connection members and opposite sides of which are fixedly coupled to a specific part of a planar lower location of the resilient mat, wherein the resilient bodies extend or are restored to the original positions according to a load applied to the resilient mat.

The resilient bodies are springs or high resiliency rubber bands.

Sides of the resilient bodies are coupled to the opposite sides of the connection members and the opposite sides of the resilient bodies are fixedly coupled to the lower frame, and the resilient bodies are fixedly coupled substantially vertically with respect to the resilient mat.

Sides of the resilient bodies are coupled to the opposite sides of the connection members, and the opposite sides of the resilient bodies are fixedly coupled to a periphery of the resilient mat.

Sides of the resilient bodies are coupled to the opposite sides of the connection members and the opposite sides of the resilient bodies are fixedly coupled to the lower frame, and the resilient bodies are fixedly coupled substantially inclinedly with respect to the resilient mat.

The connection members are wires or bands having excellent fracture characteristics and are coupled to the resilient mat with the help of a separate hook.

A mat of an expandable rubber material is further mounted on an upper side of a connection part between the resilient mat and the connection member to be spaced apart from the resiliency mat and the connection member).

Advantageous Effects

According to the present invention, an in-use space can be maximized by minimizing a space between a resilient mat and a frame, and because there is no danger factor of a spring tension space, a safety accident that is the most significant problem can be prevented.

DESCRIPTION OF MAIN PARTS OF DRAWINGS

Figure 1:
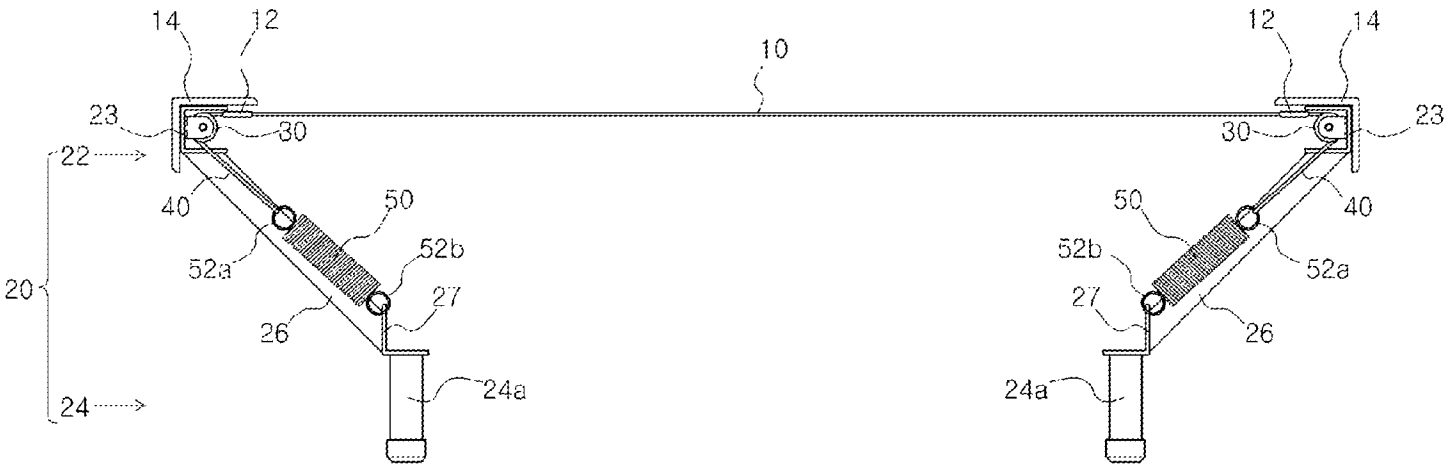
FIG. 1 is a side view schematically illustrating a main part of a trampoline according to a first embodiment of the present invention.

10: Resilient mat
20: Support frame
22: Upper frame
24: Lower frame
30: Roller
40: Connection member
50: Resilient body

BEST MODE

Mode for Invention

Hereinafter, the present invention will be described in more detail with reference to the accompanying drawings. In a description of the present invention, known functions or configurations will not be described to make the essence of the present invention clear. Throughout the specification, the same or like reference numerals denote the same or like elements.

Figure 2:
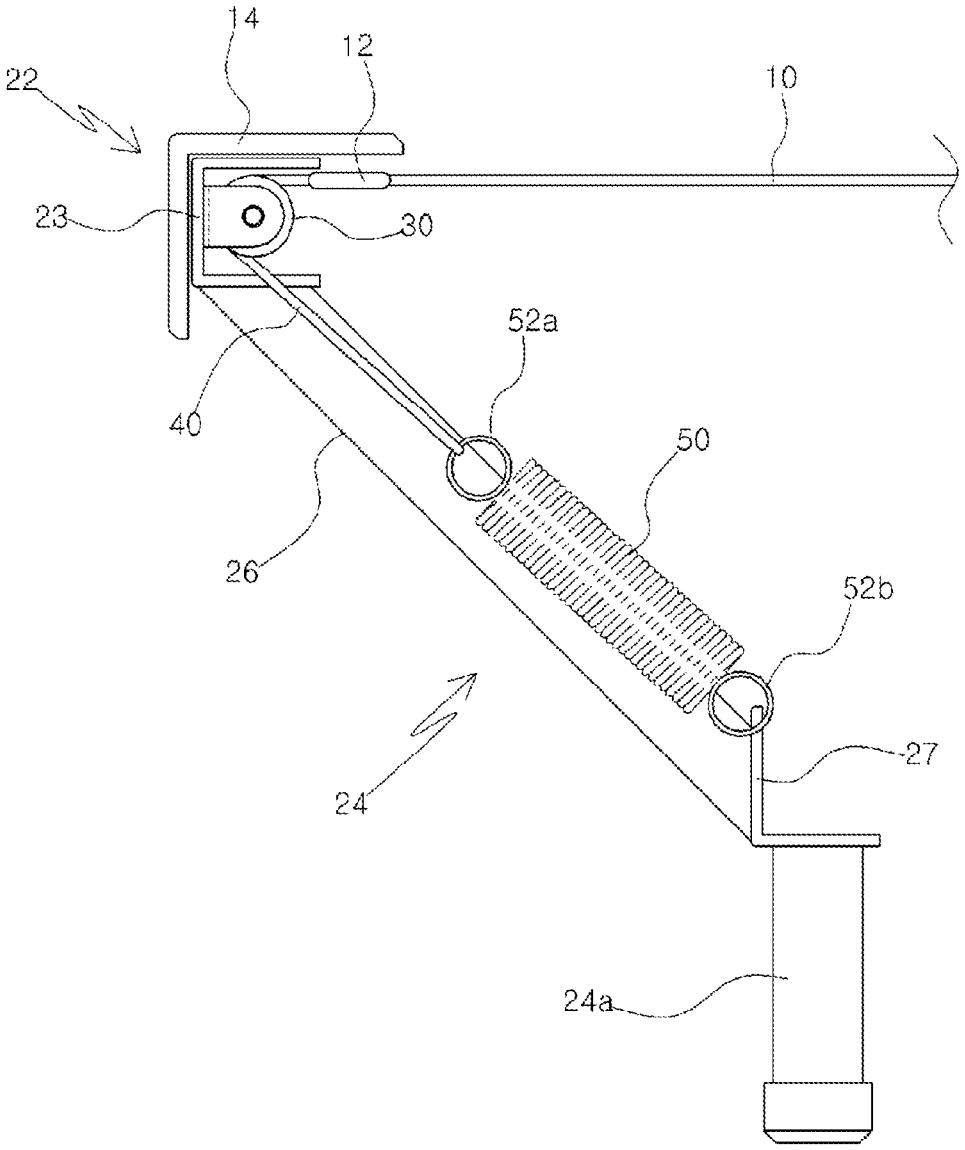
FIG. 2 is an enlarged view of a part of the trampoline of FIG. 1.

FIGS. 1 and 2 illustrate a trampoline according to a first embodiment of the present invention.

Referring to FIGS. 1 and 2, the trampoline according to the first embodiment of the present invention includes a flat resilient mat 10, and a support frame 20 including an upper frame 22 formed around the resilient mat 10 and a lower frame 24 for supporting the upper frame 22.

In particular, as illustrated in FIG. 2, a plurality of rollers 30 are mounted on the upper frame 22 arranged on an upper side of the support frame 20.

Then, the roller 30 may be directly mounted on the upper frame 22, but it is preferable that the rollers 30 are mounted via a separate outer frame 23 provided in the upper frame 22 for fixing stability as illustrated.

In the first embodiment of the present invention, a plurality of connection hooks 12 are mounted at a periphery of the resilient mat 20, and sides of connection members 40 other than the springs are connected to the connection hooks 12, respectively. The connection members 40 may be wires or high resiliency rubber bands that can endure a predetermined load, and may take any form other than a spring, which can endure a predetermined load.

Parts of the connection members 40 are wound on the rollers 30 as illustrated, and resilient bodies 50 that extend and contract according to a load are connected to opposite sides of the connection members 40. Tensile springs or high resiliency rubber bands are used as the resiliently bodies 50 without limitation. Here, the high resiliency rubber band refers to a band that can endure a preset load or more.

According to the first embodiment of the present invention, sides of the resilient bodies 50 are coupled to the opposite sides of the connection members 40, and the opposite sides of the resilient bodies 50 are fixedly coupled to the lower frame 24. Then, in particular, as illustrated in FIG. 1, the opposite ends of the resilient bodies are coupled to a specific portion 24*a* of the lower frame 24 to be substantially inclined with respect to the resilient mat 10.

Reference numeral 52*a* denotes a coupling hook coupled to the connection member 40, and reference numeral 52*b* denotes a coupling hook coupled to a resilient body fixing guide 27 provided at a specific portion 24*a* of the lower frame 24.

In the first embodiment of the present invention, a safety mat of an expandable rubber material is additionally installed to guarantee safety while the connection hooks 12, to which the resilient mat 10 and the connection members 40 are connected, may not be exposed.

The trampoline according to the first embodiment of the present invention is suitable for facilities, and guarantees safety because there is not space through which a foot of the user drops when the user jumps from the resilient mat 10 and is spatially advantageous because the entire space of the resilient mat 10 may be utilized as a jumping space.

Figure 3:
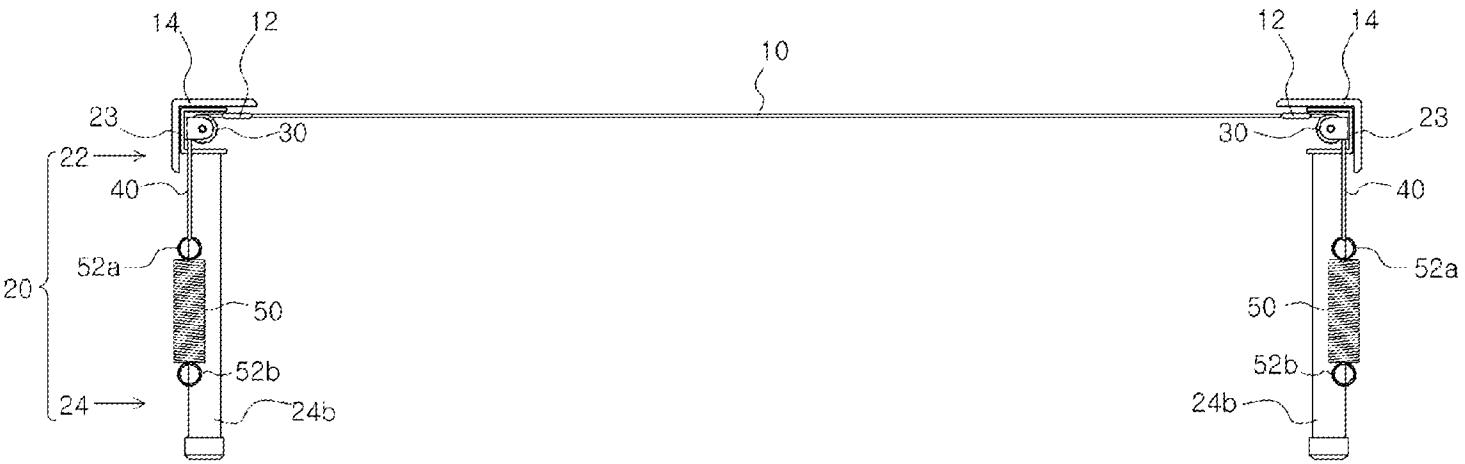
FIG. 3 is a side view schematically illustrating a main part of a trampoline according to a second embodiment of the present invention.

FIG. 3 illustrates a trampoline according to a second embodiment of the present invention.

The trampoline according to the second embodiment of the present invention illustrated in FIG. 3 is the same as that of the first embodiment except for a management aspect of the resilient body 50. Accordingly, a description of the same parts will be omitted.

In the second embodiment of the present invention, sides of the resilient bodies 50 are coupled to the opposite sides of the connection members 40 and the opposite sides of the resilient bodies 50 are fixedly coupled to the lower frame 24, and the resilient bodies 50 are fixedly coupled substantially vertically with respect to the resilient mat 10. This form of trampoline is suitable for a business.

Figure 4:
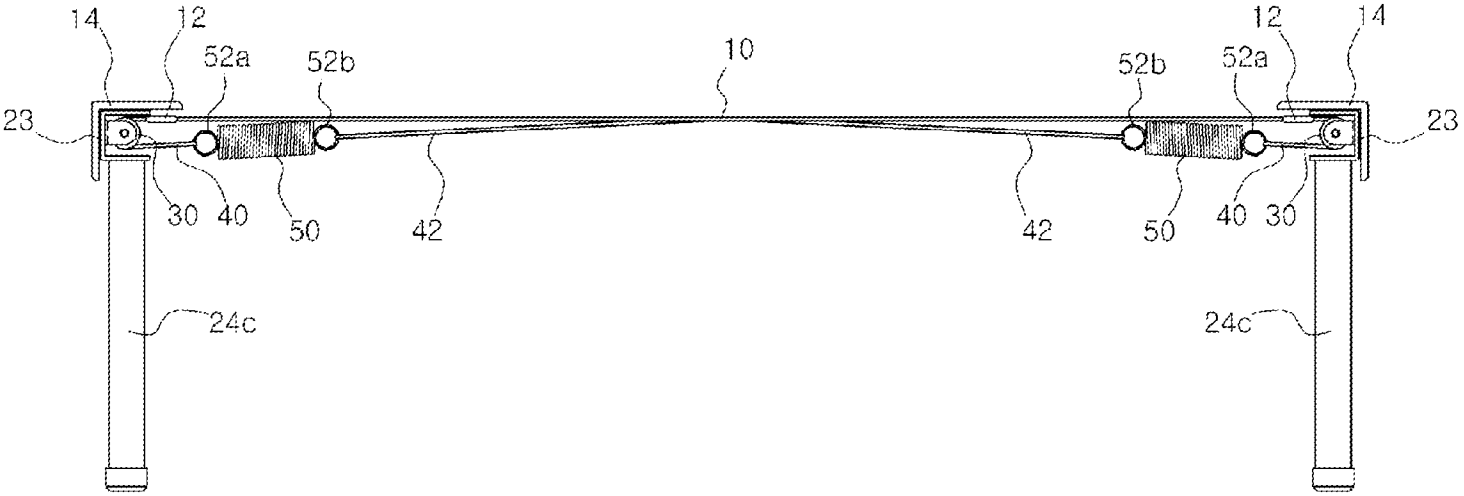
FIG. 4 is a side view schematically illustrating a main part of a trampoline according to a third embodiment of the present invention.

FIG. 4 illustrates a trampoline according to a third embodiment of the present invention.

The trampoline according to the second embodiment of the present invention illustrated in FIG. 4 is the same as that of the second embodiment except for a management aspect of the resilient body 50. Accordingly, a description of the same parts will be omitted.

According to the first embodiment of the present invention, sides of the resilient bodies 50 are coupled to the opposite sides of the connection members 40, and the opposite sides of the resilient bodies 50 are fixedly coupled to a periphery of the resilient mat 10.

Figure 5:
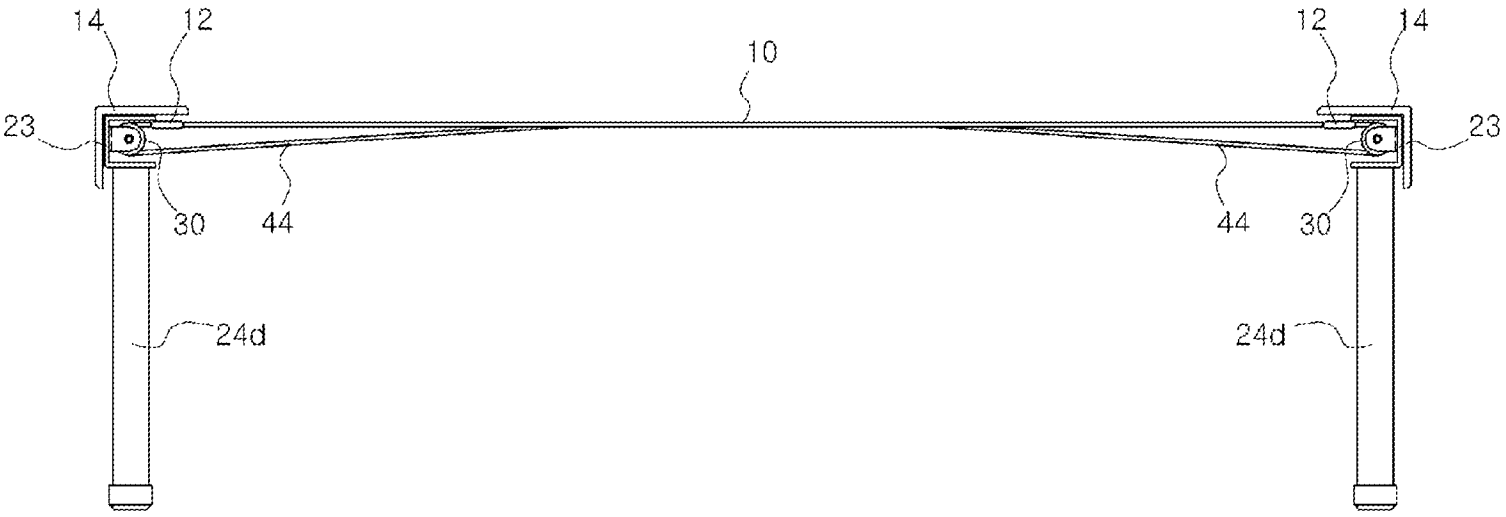
FIG. 5 is a side view schematically illustrating a main part of a trampoline according to a fourth embodiment of the present invention.

FIG. 5 illustrates a trampoline according to a fourth embodiment of the present invention.

The trampoline according to the second embodiment of the present invention illustrated in FIG. 5 is the same as that of the second embodiment except that high resiliency rubber bands are used as the resilient bodies 50.

The invention claimed is:

1. A safe trampoline comprising a flat resilient mat including an upper frame formed around the resilient mat and a lower frame for supporting the upper frame, the trampoline comprising:

a plurality of rollers mounted on the upper frame;

connection members, sides of which are indirectly or directly coupled to a periphery of the resilient mat and opposite sides of which are partially wound on the rollers; and resilient bodies, sides of which are coupled to the opposite sides of the connection members and opposite sides of which are fixedly coupled to a specific part of a planar lower location of the resilient mat, wherein the resilient bodies extend or are restored to the original positions according to a load applied to the resilient mat.

2. The safe trampoline of claim 1, wherein the resilient bodies are springs or high resiliency rubber bands.

3. The safe trampoline of claim 2, wherein sides of the resilient bodies are coupled to the opposite sides of the connection members and the opposite sides of the resilient bodies are fixedly coupled to the lower frame, and the resilient bodies are fixedly coupled substantially vertically with respect to the resilient mat.

4. The safe trampoline of claim 2, wherein sides of the resilient bodies are coupled to the opposite sides of the connection members, and the opposite sides of the resilient bodies are fixedly coupled to a periphery of the resilient mat.

5. The safe trampoline of claim 2, wherein sides of the resilient bodies are coupled to the opposite sides of the connection members and the opposite sides of the resilient bodies are fixedly coupled to the lower frame, and the resilient bodies are fixedly coupled substantially inclinedly with respect to the resilient mat.

6. The safe trampoline of claim 1, wherein the connection members are wires or bands coupled to the resilient mat with respective hooks.

7. The safe trampoline of claim 1, wherein a mat of an expandable rubber material is further mounted on an upper side of a connection part between the resilient mat and the connection member to be spaced apart from the resiliency mat and the connection member.

* * * * *